US007469553B2

(12) United States Patent
Wu et al.

(10) Patent No.: US 7,469,553 B2
(45) Date of Patent: Dec. 30, 2008

(54) TILT-OUT ICE BIN FOR A REFRIGERATOR

(75) Inventors: Guolian Wu, St. Joseph, MI (US); Claiton Emilio Do Amaral, Joinville (BR); Marcus R. Fischer, St. Joseph, MI (US); Marcos Heinzle, Joinville (BR); Jean Marcelo Ferreira, Joinville (BR); Luis Fernando Welin, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 381 days.

(21) Appl. No.: 11/283,970

(22) Filed: Nov. 21, 2005

(65) Prior Publication Data

US 2007/0113578 A1 May 24, 2007

(51) Int. Cl.
*F25C 5/18* (2006.01)

(52) U.S. Cl. ..... 62/344; 312/405.1

(58) Field of Classification Search ..... 62/344; 312/405.1

See application file for complete search history.

(56) References Cited

U.S. PATENT DOCUMENTS

| | | | | |
|---|---|---|---|---|
| 1,670,959 | A | 5/1928 | Garrett | |
| 2,576,691 | A | 11/1951 | Money | 312/214 |
| 2,694,906 | A | 11/1954 | Didion | 62/89 |
| 3,218,111 | A | 11/1965 | Steiner | 312/214 |
| 3,308,632 | A | 3/1967 | Winfield, Jr. | 62/137 |
| 3,519,319 | A | 7/1970 | Taylor | |
| 3,545,217 | A | 12/1970 | Linstromberg | 62/137 |
| 3,561,231 | A | 2/1971 | Webb | 62/344 |
| 3,602,007 | A | 8/1971 | Drieci | 62/344 |
| 3,621,668 | A | 11/1971 | Swerbinsky | 62/137 |
| 3,635,043 | A | 1/1972 | Sterling | 62/137 |
| 3,643,464 | A | 2/1972 | Hilliker et al. | 62/344 |
| 3,883,204 | A | 5/1975 | Prada et al. | 312/373 |
| 4,095,439 | A | 6/1978 | Linstromberg | 62/344 |
| 4,098,094 | A | 7/1978 | Linstromberg | 62/344 |
| 4,100,761 | A | 7/1978 | Linstromberg et al. | 62/137 |
| 4,186,978 | A | 2/1980 | Thomson | 312/138 |
| 4,269,039 | A | 5/1981 | Baker | 62/344 |
| 4,333,588 | A * | 6/1982 | Schreck et al. | 222/164 |

(Continued)

FOREIGN PATENT DOCUMENTS

EP 1482263 A2 12/2004

(Continued)

*Primary Examiner*—William E Tapolcai
(74) *Attorney, Agent, or Firm*—Kirk Goodwin; Michael D. Lafrenz

(57) ABSTRACT

A refrigerator having an insulated cabinet and a door pivotally mounted to the cabinet having an exterior face including a dispenser cavity. An ice maker in the refrigerated storage space is arranged to make and harvest ice pieces. An ice delivery system on the inside of the door dispenses ice pieces into a dispenser cavity in the exterior face of the door. The ice delivery system can include an ice bin including a generally open top and having a bottom opening pivotally mounted on a horizontal axis below the ice maker. The ice can receive ice pieces harvested by the ice maker and discharge ice pieces through the bottom opening and the ice delivery system in a first position. The ice bin can tilt out to permit access to ice pieces, and can be removed from the ice delivery system, in a second position when the door is open.

28 Claims, 8 Drawing Sheets

U.S. PATENT DOCUMENTS

| | | | | |
|---|---|---|---|---|
| 5,273,219 | A | 12/1993 | Beach, Jr. et al. | |
| 6,050,097 | A | 4/2000 | Nelson et al. | 62/137 |
| 6,082,130 | A | 7/2000 | Pastryk et al. | 62/344 |
| 6,148,624 | A | 11/2000 | Bishop et al. | 62/137 |
| 6,286,324 | B1 | 9/2001 | Pastryk et al. | 62/137 |
| 6,314,745 | B1 | 11/2001 | Janke et al. | 62/137 |
| 6,351,958 | B1 | 3/2002 | Pastryk et al. | 62/137 |
| 6,425,259 | B2 | 7/2002 | Nelson et al. | 62/344 |
| 6,442,954 | B1 | 9/2002 | Shapiro et al. | 62/137 |
| 6,742,855 | B2 | 6/2004 | Whitaker et al. | 312/405.1 |
| 6,905,183 | B2 | 6/2005 | Leimkuehler et al. | 312/405.1 |
| 2004/0012314 | A1 | 1/2004 | Hay et al. | 312/405.1 |

FOREIGN PATENT DOCUMENTS

| | | | |
|---|---|---|---|
| JP | 2002031444 | A | 1/2002 |
| KR | 20050094672 | A | 9/2005 |
| WO | 03/102481 | A1 | 12/2003 |

* cited by examiner

TILT-OUT ICE BIN FOR A REFRIGERATOR

CROSS REFERENCE TO RELATED APPLICATIONS

This application is related to pending U.S. patent application Ser. No. 10/973,543, filed Oct. 24, 2004 and U.S. patent application Ser. No. 10/973,559, filed Oct. 24, 2004.

BACKGROUND OF THE INVENTION

1. Field of the Invention

The invention relates to refrigerator freezers equipped with an ice dispenser. More particularly the invention relates to an ice dispenser mounted on the inside of a door closing the freezer compartment or the refrigerator compartment.

2. Description of the Invention

Refrigerator freezers having ice and water dispensers are known. Ice dispensers having an ice storage bin carried on the inside panel of one of the doors of the refrigerator freezer are also known.

SUMMARY OF THE INVENTION

In one aspect the invention relates to a refrigerator having an insulated cabinet defining a refrigerated storage space, a door pivotally mounted to the cabinet for selectively opening and closing the refrigerated storage space and having an exterior face. The refrigerator can include an ice maker in the refrigerated storage space arranged to make and harvest ice pieces and an ice delivery system on the inside of the door for dispensing ice pieces into a dispenser cavity in the exterior face of the door. The ice dispensing system can include an ice bin including a generally open top and having a bottom opening. The ice bin can be pivotally mounted below the ice maker to receive ice pieces harvested by the ice maker and to discharge ice pieces through the bottom opening and the ice delivery system in a first position, and to tilt out to permit access to ice pieces in a second position when the door is open.

The ice bin can be removed from the refrigerator in the second position.

The ice maker can be mounted on the door and can close the open top of the ice bin when the ice bin is in the first position. The ice delivery system can include a motor, the ice bin can include an auger, and the auger can be drivingly connected to the motor when the ice bin is in the first position.

The ice delivery system can further include an ice bin base and the ice bin can be pivotally mounted on a generally horizontal axis to the ice bin base. The ice bin can further include a pair of pivot pins and the ice bin base can further include a pair of sockets for receiving the pivot pins to pivotally mount the ice bin to the ice bin base. The sockets can include a peripheral opening for insertion and withdrawal of the pivots into and from the sockets when the ice bin is in the second position.

The ice bin can include side walls, a front wall and a rear wall, and the pivot pins can comprise a generally D-shaped pin on each of the side walls adjacent the bottom edge of the side wall and the front wall. The sockets can comprise a support extending upwardly from the ice bin base, and can have a recess including a curvilinear wall defining the socket to receive the D-shaped pin. The D-shaped pin can comprise a curved wall and a generally flat wall. The D-shaped pin curved wall can engages the socket curvilinear wall to form a moving pivot point for the ice bin as the ice bin is pivoted from the first position to the second position.

In another aspect of the invention the ice bin can include side walls, a front wall and a rear wall, and the pivot pins can comprise a generally cylindrical pin on a side wall of the ice bin adjacent the bottom edge of the side wall and the front wall. The sockets can comprise a support extending upwardly from the ice bin base having a recess including a generally cylindrical wall defining the socket to receive the generally cylindrical pin.

In another aspect of the invention the ice bin can include side walls, a front wall and a rear wall, and the sockets can comprise a support extending upwardly from the ice bin base having a recess for receiving the pivot pin. At least one of the supports can further include a stop pin positioned above the socket, and the ice bin can further include a curved track on at least one side wall of the ice bin arranged for receiving the at least one stop pin and can have a stop surface to engage the stop pin when the ice bin is in the second position to prevent the ice bin from pivoting past the second position.

In another aspect of the invention the ice bin can include side walls, a front wall and a rear wall, and the pivot pins can comprise a shaft having opposed generally flat surfaces. The sockets can have a recess including a first stop having first and second stop surfaces to engage one of the flat surfaces and a second stop having first and second stop surfaces to engage the other flat surface. When the ice bin is in the first position the first stop surfaces engage opposite flat surfaces to prevent the shaft from rotating further toward the first position, and when the ice bin is in the second position the second stop surfaces engage opposite flat surfaces to prevent the shaft from rotating further toward the second position.

In another aspect of the invention the refrigerator can include a plate pivotally mounted on an ice bin base and the ice bin can engage the plate for pivotal movement with the plate. The plate can include a base and at least one vertical element, and the ice bin can further include a wall arranged to engage the at least one vertical element to hold the ice bin on the plate. The plate can include spaced vertical elements and the wall can include a portion received between the spaced vertical elements. The wall portion and the vertical elements can be arranged to allow the ice bin to be removed from the plate when the ice bin is in the second position.

In another aspect of the invention the ice bin can include a latch arranged to secure the ice bin in the first position under the ice maker.

In another aspect of the invention the ice bin can include a damper connected between the ice bin and the door to damp movement of the ice bin between the first position and the second position. The ice delivery system can include an ice bin base and the ice bin can be pivotally mounted to the ice bin base. The damper can comprise a viscous damper connected between the ice bin and the ice bin base.

In another aspect of the invention the refrigerator is a side by side refrigerator freezer and the ice maker can be mounted on the freezer door above the ice bin and closes the open top of the ice bin when the ice bin is in the first position.

In another aspect of the invention the refrigerator is a bottom freezer refrigerator freezer and the ice maker can be mounted on the refrigerator compartment door above the ice bin. Below freezing air can be supplied to the door for the ice maker and the ice bin. The ice maker and ice bin can include a closure arranged to enclose below freezing air supplied to the door.

In another aspect of the invention a refrigerator freezer can include a freezer compartment having an access opening and a freezer door for closing the freezer compartment. An ice maker can be positioned on the freezer door and an ice delivery system can be provided on the freezer door for dispensing ice pieces into a dispenser cavity in the exterior face of the freezer door. The ice delivery system can include an ice bin positioned below the ice maker and can have a generally open top, side walls, a front wall and a bottom opening. The ice delivery system can include an ice bin base mounted on the freezer door removably supporting the ice bin for pivotal movement along a generally horizontal axis between a first position with the open top closed by the ice maker to receive ice pieces harvested by the ice maker and to discharge ice pieces through the bottom opening to the dispenser cavity, and to pivot to a second position with the open top exposed to permit access to ice pieces and removal of the ice bin from the ice bin base when the freezer door is open. The ice bin can include a pair of pivot pins and the ice bin base can include a pair of sockets each having a recess comprising a curvilinear wall arranged to receive a pivot pin to pivotally mount the ice bin to the ice bin base. The sockets can include a peripheral opening into the recess for insertion and withdrawal of a pivot pin into and from the recess when the ice bin is in the second position.

In another aspect of the invention a refrigerator freezer can include a refrigerator compartment having an access opening and a refrigerator door for closing the refrigerator compartment. The refrigerator freezer can supply below freezing air to the refrigerator door. An ice maker can be positioned on the refrigerator door and an ice delivery system can be provided on the refrigerator door for dispensing ice pieces into a dispenser cavity in the exterior face of the refrigerator door. The ice delivery system can include an ice bin positioned below the ice maker and can have a generally open top, side walls, a front wall and a bottom opening. An ice bin base can be mounted on the refrigerator door removably supporting the ice bin for pivotal movement along a generally horizontal axis between a first position with the open top closed by the ice maker to receive ice pieces harvested by the ice maker and to discharge ice pieces through the bottom opening to the dispenser cavity, and to pivot to a second position with the open top exposed to permit access to ice pieces and removal of the ice bin from the ice bin base when the freezer door is open. The ice bin can include a pair of pivot pins and the ice bin base can include a pair of sockets each having a recess arranged to receive a pivot pin to pivotally mount the ice bin to the ice bin base. The sockets can include a peripheral opening into the recess for insertion and withdrawal of a pivot pin into and from the recess when the ice bin is in the second position. The ice delivery system can include a closure for the ice maker and the ice bin arranged to enclose below freezing air supplied to the refrigerator door for the ice maker and ice bin.

DESCRIPTION OF THE INVENTION

One of the most desired accessories for a household refrigerator is a through-the-door ice and water system. A through-the-door ice and water dispenser is desirable because it greatly simplifies the process of retrieving ice cubes, i.e. it eliminates opening the door, removing the ice cube storage bin, separating and scooping ice cubes, and pouring the ice cubes into a glass. The feature also can be viewed as an energy saver, since the freezer door is not opened as often.

In today's household refrigerator market, there are three basic configurations to choose from: a bottom freezer refrigerator in which the refrigerator compartment is located above the freezer compartment, a top-mount refrigerator in which the freezer compartment is located above the refrigerator compartment, and a side by side refrigerator in which the refrigerator compartment and the freezer compartment extend the entire height of the refrigerator.

In the side by side configuration the ice cube storage bin and dispenser can be positioned on the freezer compartment door. It would be advantageous to also position the ice maker on the freezer door to provide additional shelf storage space in the freezer compartment. Likewise, it would be desirable to provide ice and water dispensers for bottom freezer refrigerators. However, to do so essentially requires providing ice making and storage mechanisms in the refrigerator compartment or on a refrigerator compartment door. Related co-pending U.S. patent application Ser. No. 10/973,559 is directed to ice makers arranged for installation and operation on a refrigerator or freezer compartment door. Co-pending U.S. patent application Ser. No. 10/973,559 is incorporated herein by reference.

U.S. Pat. Nos. 6,050,097, 6,082,130 and 6,148,624 disclose refrigerator freezers with an ice bin positioned on the freezer compartment door. In the ice dispensing system embodiments described in U.S. Pat. Nos. 6,050,097 and 6,082,130 an ice maker can be positioned on the top wall of the freezer compartment and an ice bin can be removable from the freezer door to allow the user to readily remove the ice bin and dump a large quantity of ice into a receptacle. In the embodiment described in U.S. Pat. No. 6,148,624 the ice maker can be raised out of the ice storage receptacle to allow the ice storage receptacle to pivot out from under the ice maker on a vertical axis and, if desired, be removed from the freezer door.

Figure 1:
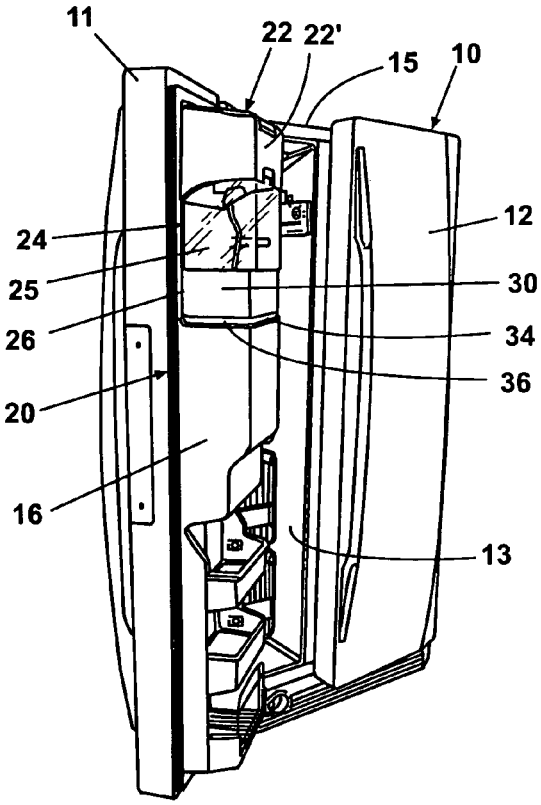
FIG. 1 is a front perspective view of a side by side refrigerator freezer having one embodiment of ice dispensing system according to the invention.
Figure 2:
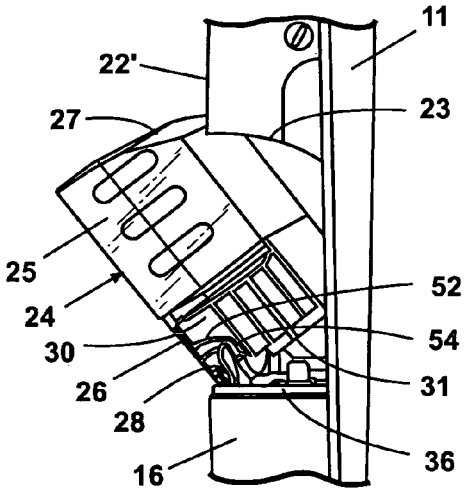
FIG. 2 is a fragmentary side view of a one embodiment of an ice dispensing system according to the invention illustrating the ice bin tilted out for access to ice pieces through the open top of the ice bin.
Figure 3:
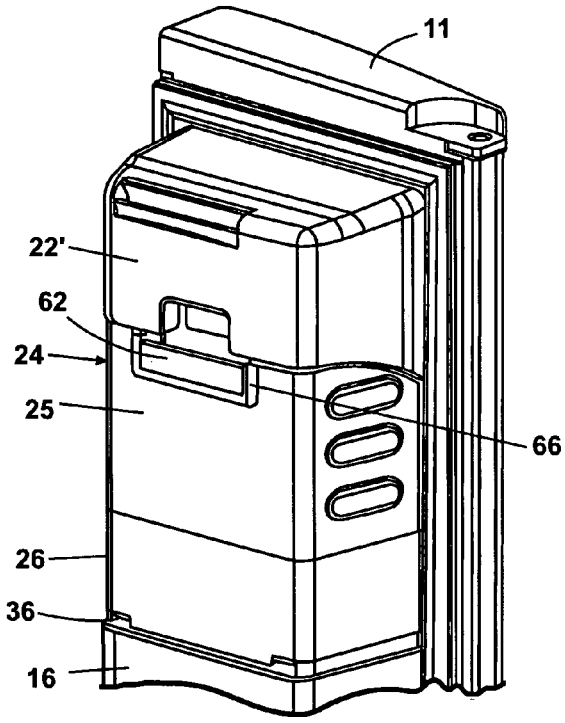
FIG. 3 is a fragmentary perspective view of the ice dispensing system according to the invention illustrating a latching arrangement for the ice bin.

Turning to FIGS. 1-3, an ice dispensing system 20 according to the invention can be seen. In the embodiment illustrated in FIGS. 1-3 refrigerator freezer 10 can be a side by side refrigerator freezer having a freezer compartment door 11 and a refrigerator compartment door 12 pivotally mounted on cabinet 15 as is well known in the art. Freezer compartment door 11 can close freezer compartment 13 as is well known in the prior art. An ice maker 22, enclosed by ice maker cover 22' can be mounted at the top of freezer door 11 and can have water and electric leads, not shown, provided through a hollow hinge pin, not shown, from cabinet 15. Ice maker 22 can produce and harvest ice pieces automatically as is well known in the art. Ice maker 22 can be an ice maker as disclosed in related U.S. patent application Ser. No. 10/973,559 incorporated by reference in this application. Ice maker 22 can be similar to ice maker 122' in FIG. 9A described below.

Figure 7:
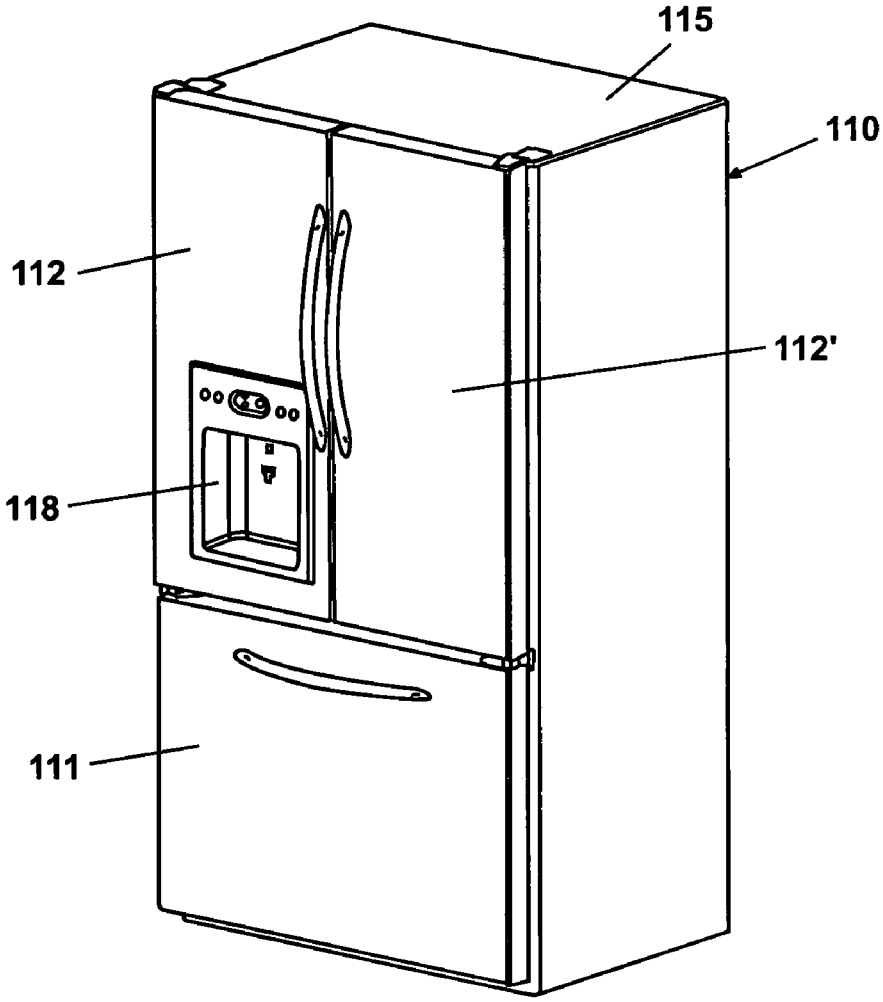
FIG. 7 is a perspective view of a bottom freezer refrigerator freezer having an embodiment of an ice dispensing system according to the invention.

An ice bin 24 can be positioned below ice maker 22 to receive ice pieces harvested by ice maker 22. Ice bin 24 can have an upper ice bin member 25 that can be clear plastic material to allow a user to visually determine the amount of ice in upper ice bin member 25. Ice bin 24 can also have a lower ice bin member 26. Lower ice bin member 26 can support desired ice dispensing mechanism and can include a funnel wall portion, not shown, and a bottom opening, not shown, for ice pieces being dispensed. U.S. Pat. Nos. 6,050,097 and 6,082,130, incorporated by reference herein, disclose a lower ice bin member and ice dispensing mechanism that can be incorporated in lower ice bin member 26 for causing ice to be dispensed from ice bin 24 through freezer door 11 into a dispenser cavity, not shown, on the face of door 11. The dispenser cavity, not shown, on the face of freezer compartment door 11 can be similar to dispenser cavity 118 in FIG. 7. Inner door panel 16 can enclose a motor, motor housing and drive arrangement, all not shown, that can be arranged to drive ice dispensing system 20. A motor, motor housing and drive arrangement similar to the motor, motor housing and drive arrangement disclosed in U.S. Pat. Nos. 6,050,097 and 6,082,130 can be used in ice dispensing system 20.

Figure 2A:
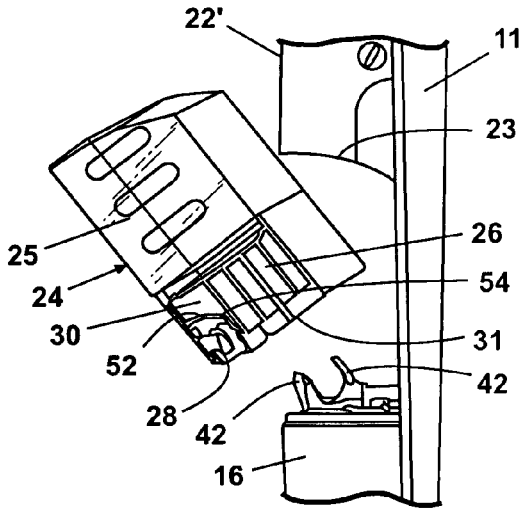
FIG. 2A is a fragmentary side view of the ice dispensing system embodiment illustrated in FIG. 2 with the ice bin separated from the ice dispensing system.

In the closed position illustrated in FIGS. 1 and 3, ice bin 24 can receive ice pieces from ice maker 22. Ice maker 22 can have a housing with an curved edge 23 that can generally match the top edge 27 of upper ice bin member 25 to substantially enclose ice bin 24 when ice bin 24 is in the closed position illustrated in FIGS. 1 and 3 with ice bin cover 22' closed. As described in U.S. Pat. Nos. 6,050,097 and 6,082,130 ice bin 24 can include an auger 32 that can be driven by the ice dispensing mechanism, not shown, in lower ice bin member 26 when the dispensing mechanism is operated. Auger 32 can agitate ice pieces in upper ice bin member 25 to facilitate ice pieces falling into the ice dispensing mechanism for dispensing into the dispenser cavity, not shown. Unlike the ice bins shown in U.S. Pat. Nos. 6,050,097 and 6,082,130, ice bin 24 can not be lifted vertically for removal from ice dispensing system 20. As mentioned above, it can be convenient for a user to remove an ice bin for bulk dispensing of ice pieces into a cooler, or for cleaning the ice bin. According to the invention ice bin 24 can be pivotally mounted to the ice dispensing system 20 about a generally horizontal axis for movement between the closed position illustrated in FIGS. 1 and 3 to a tilted out position illustrated in FIG. 2. In the tilted out position ice pieces can be manually removed by reaching into the open top of upper ice bin member 25. Further, in the tilted out position ice bin 24 can be removed from ice dispensing system 20 for bulk dispensing of ice into a cooler or other container or for cleaning as desired, see FIG. 2A.

Figure 6:
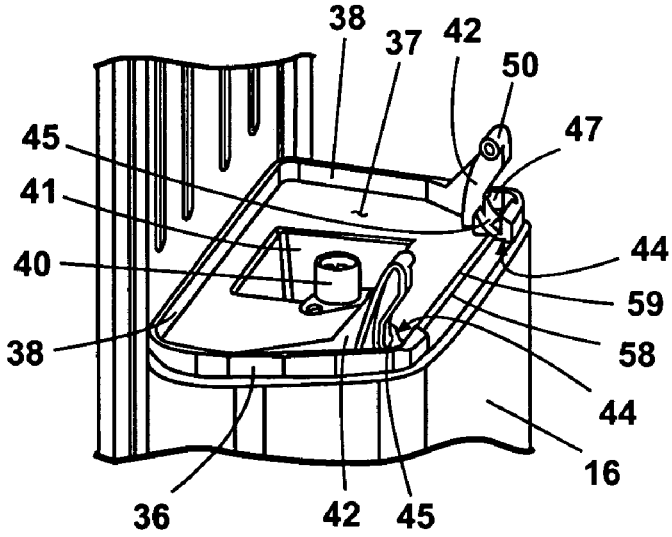
FIG. 6 is a partial perspective view of an embodiment of an ice bin base according to the invention on a door.

Turning to FIG. 6 the pivotal mounting for ice bin 24 can be seen in greater detail. Ice bin base 36 can have a generally flat portion 37 that can provide a support for ice bin 24. Flat portion 37 can have a peripheral wall 38 extending around a substantial portion of flat portion 37 to provide a seat for ice bin 24. Peripheral wall 38 can hold ice bin 24 in proper alignment with drive coupling 40. Drive coupling 40 can connect to a drive for auger 32 and dispensing mechanism, not shown, in lower ice bin member 26 to a motor, not shown, that can be positioned below ice bin base 36. Those skilled in the art will understand that lower ice bin member 26 can have a complimentary drive coupling, not shown. The complimentary drive coupling, not shown, can connect the ice dispensing mechanism, not shown, in lower ice bin member 26 and auger 32 to drive coupling 40 when ice bin 24 is in the position shown in FIGS. 1 and 3. Further, those skilled in the art will understand that the complimentary drive coupling, not shown, can be arranged to readily engage drive coupling 40 as ice bin 24 is tipped from the tilted position shown in FIG. 2 to the position in FIG. 1 without user intervention. For example drive coupling 40 can be a coupling such as used in the ice dispensing systems described in U.S. Pat. Nos. 6,050,097 and 6,082,130. Ice bin base 36 can also have a chute 41 formed in flat surface 37 that can lead to a dispensing cavity, not shown, on the exterior face of freezer door 11 that can be similar to dispensing cavity 118 in FIG. 7.

Figure 4:
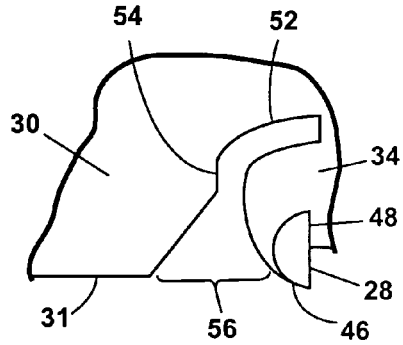
FIG. 4 is a partial schematic view of the side wall of an ice bin according to the invention illustrating the pivot pin and bin stop of the embodiment of FIGS. 1-3 of the invention.
Figure 5:
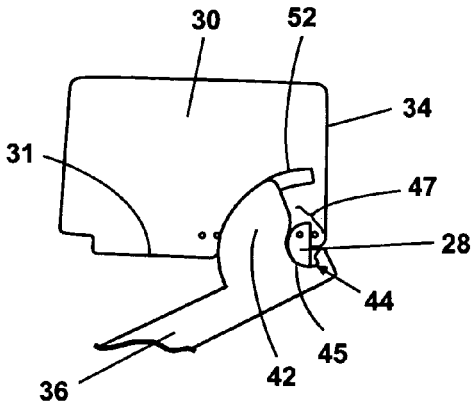
FIG. 5 is a partial schematic view of the side wall of an ice bin engaging a support on an ice bin base illustrating the operation of the pivot pin of the embodiment of FIGS. 1-3 of the invention.
Figure 5A:
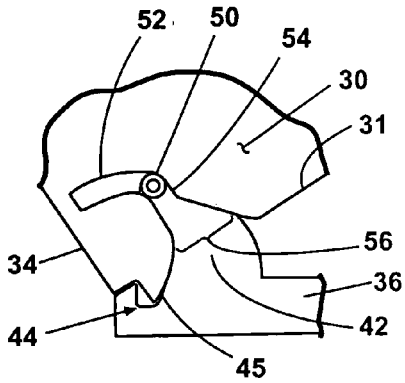
FIG. 5A is a partial schematic view of the side wall of an ice bin engaging a support on an ice bin base from the opposite side shown in FIG. 5 illustrating operation of the bin stop of the embodiment of FIGS. 1-3 of the invention.

Turning to FIGS. 4-5A the relationship between ice bin base 36 and ice bin side walls 30 can be seen in schematic form with portions of the ice bin base 36 and ice bin 24 removed to show the edge of ice bin base 36, supports 42 and the side wall 30 of ice bin 24. Ice bin base 36 can include a pair of supports 42 positioned at the edge of ice bin base 36 away from the exterior face of freezer compartment door 11. Supports 42 can include a recess forming a socket 44 that can receive a pivot pin 28 positioned on a side wall 30 adjacent the bottom edge 31 and front wall 34. In the embodiment of FIGS. 1-6, pivot pin 28 can be D-shaped having a curved wall 46 and a generally flat wall 48. Socket 44 can include a curvilinear wall 45 defining the recess. Socket 44 can also have a peripheral opening 47 that can allow a pivot pin 28 to be inserted into or withdrawn from socket 44 when ice bin 24 is in the position shown in FIG. 2. Curved wall 46 can engage curvilinear wall 45 (see FIG. 5) to form a pivot point as ice bin 24 is pivoted from the position shown in FIG. 1 to the position shown in FIGS. 2, 5 and 5A. The pivot point formed by the engagement of curved wall 46 and curvilinear wall 45 can be a moving pivot point that can move upwardly as ice bin 24 is tilted from the FIG. 1 position to the FIG. 2 position. A moving pivot point can allow front wall 34 of ice bin 24 to be positioned close to ice bin base 36 to minimize the space between ice bin 24 and ice bin base 36. Those skilled in the art will understand that a fixed pivot point for ice bin 24 could require larger gap between lower ice bin member 26 and ice bin base 36 to avoid interference of lower ice bin member 26 with ice bin base 36 as ice bin 24 is tilted to the FIG. 2 position.

Support 42 can also include a stop pin 50 that can be positioned above socket 44. Stop pin 50 can be received in a curved track 52 that can be formed in side wall 30 on at least one side of lower ice bin member 26. A stop pin 50 and curved track 52 can be provided for both sides 30 of lower ice bin member 30. Curved track 52 can include a stop surface 54 to engage stop pin 50 when ice bin 24 is tilted to the FIGS. 2, 5 and 5A position. Stop pin 50 and stop surface 54 can be designed sufficiently strong to support ice bin 24 in the FIG. 2 position without moving past the FIG. 2 position and inadvertently discharging the ice pieces. The configuration of curved track 52, pivot pin 28 and peripheral opening 47 can be arranged to allow ice bin 24 to be easily lifted off ice bin base 36 when ice bin 24 is in the FIG. 2 position by withdrawing ice bin 24 upwardly in a direction generally parallel to the sides of ice bin 24, see FIG. 2A. As can best be seen in FIG. 5A, pivot pin 28 can pass through peripheral opening 47 and stop pin 50 can pass through the flared entrance 56 to curved track 54 when ice bin 24 is positioned in the FIG. 2 position. Thus, while ice bin 24 can be easily removed from ice bin base 36 in the FIG. 2 position, the configuration of pivot pin 28, socket 44 and stop pin 50 and stop surface 54 can assure that ice bin 24 can not tilt further than the FIG. 2 position and discharge ice pieces on the floor or drop from freezer compartment door unexpectedly.

Returning to FIG. 6, generally flat portion 37 of ice bin base 36 can comprise a stop 58 having a front edge 59 that can be positioned to engage the inside surface, not shown, of front wall 34 of lower ice bin member 26 when ice bin 24 is in the FIG. 2 position. Stop 58 engaging the inside of front wall 30 can supplement stop pins 50 engaging stop surfaces 54 in assuring that an excess load placed on ice bin 24 in the FIG. 2 position will not cause ice bin 24 to tilt past the FIG. 2 position.

Turning to FIGS. 7-9A another embodiment of the invention can be seen. Refrigerator freezer 110 can have a bottom freezer configuration. Refrigerator freezer 110 can have a cabinet 115 arranged to have an upper refrigerator compartment 114 with refrigerator doors 112 and 112' pivotally mounted to cabinet 115 as is well known in the art. Those skilled in the art will understand that refrigerator compartment 114 can be provided with a single door instead of the double door 112 and 112' shown in FIGS. 7-9. Refrigerator 110 can have an ice dispensing system 120 that can be mounted on refrigerator door 112. Ice dispensing system 120 can include a dispenser cavity 118 on the face of refrigerator door 112. Ice dispensing system can include an ice maker 122 behind ice maker cover 123 at the top of refrigerator door 112, see FIG. 9A. Ice bin cover 123 can be insulated. Ice bin 124 can be pivotally mounted on ice bin base 136 as will be described in greater detail below. Ice bin 124 can have an insulated cover 125. Door 112 can have an inner door panel 116 that can form a housing below ice maker 122 and ice bin 124. Refrigerator 110 can be arranged to provide below freezing air to refrigerator door 112 through door air couplings 117 and cabinet air couplings 119. The system for providing below freezing air to ice maker 122 and ice bin 124 can be an air delivery system described in detail in related co-pending U.S. patent application Ser. No. 10/973,543. U.S. patent application Ser. No. 10/973,543 is fully incorporated by reference and the air delivery system will not be described in detail in this application. Ice maker cover 123 and ice bin door 125 can be insulated and can enclose the ice maker 122 and ice bin 124 to maintain the ice maker 122 and ice bin 124 at below freezing temperatures. The below freezing enclosure can be arranged for minimum leakage of below freezing air into refrigerator compartment 114 as described in the above referenced co-pending patent application.

Figure 8:
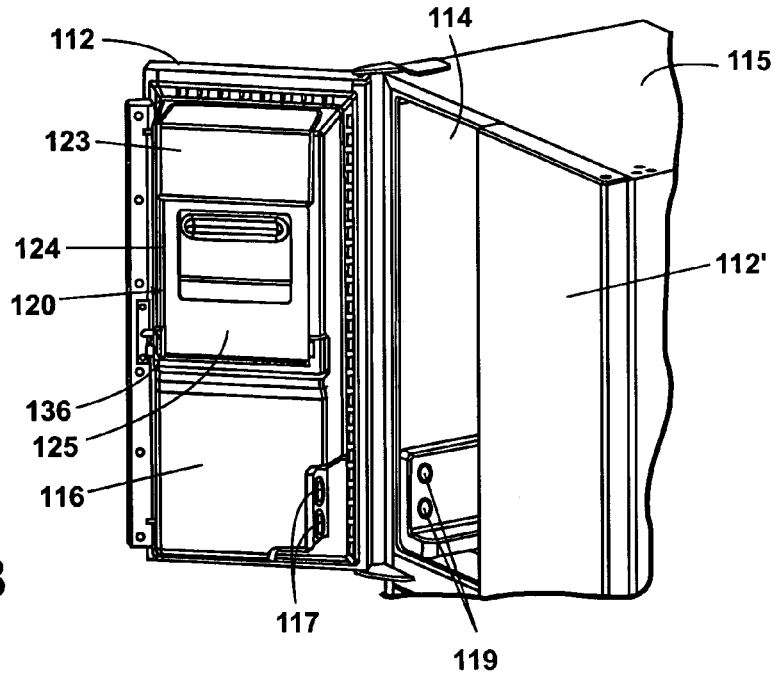
FIG. 8 is a partial perspective view of the bottom freezer refrigerator freezer of FIG. 7 with one of the refrigerator doors partially opened illustrating the inside of the refrigerator door.
Figure 9:
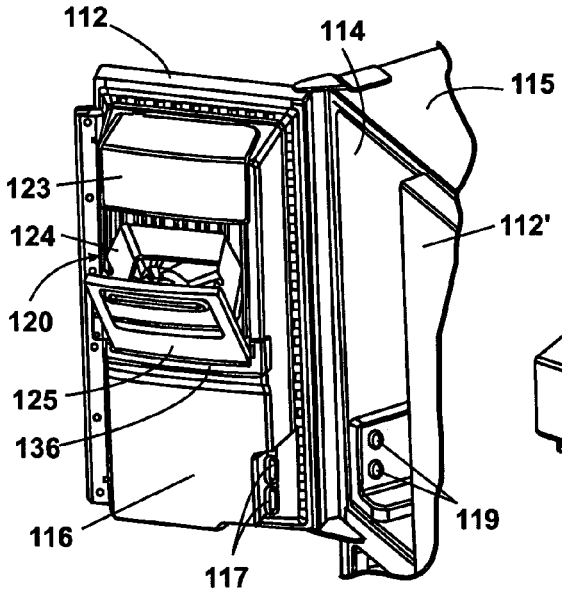
FIG. 9 is a partial perspective view of the bottom freezer refrigerator freezer of FIG. 7 with one of the refrigerator doors partially opened illustrating the ice bin tilted out for access to ice pieces through the open top of the ice bin.
Figure 9A:
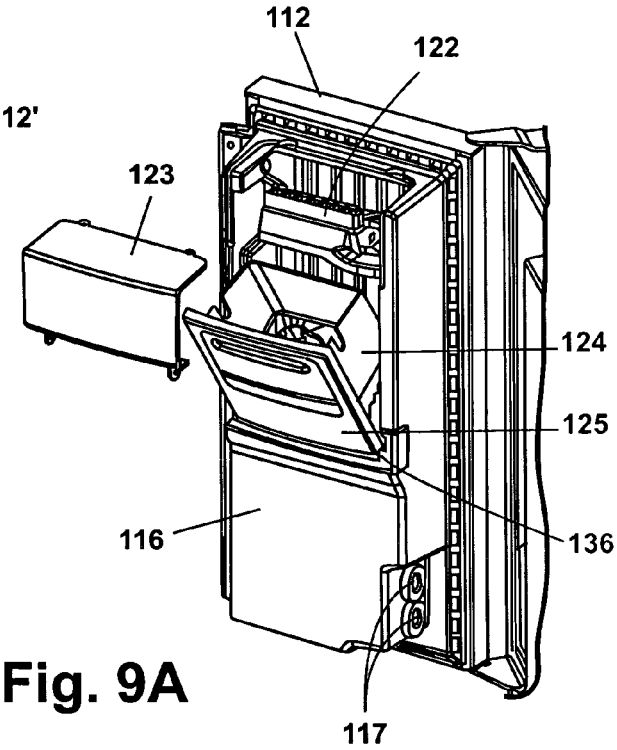
FIG. 9A is a partial perspective view of the refrigerator door of FIG. 9 with the ice maker cover removed illustrating the position of the ice maker.
Figure 14:
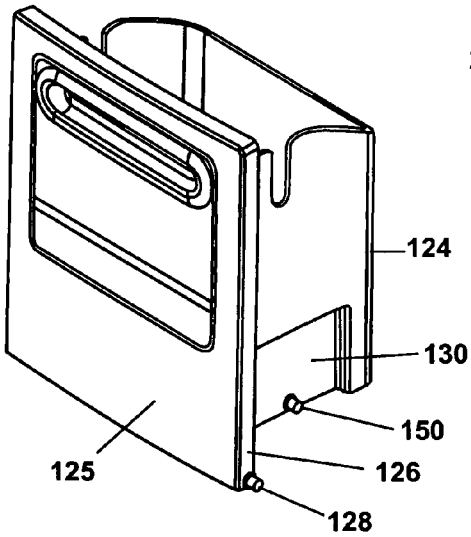
FIG. 14 is a partial side view of an embodiment of an ice bin that can be used with the ice dispensing system embodiment of FIGS. 7-9.
Figure 15:
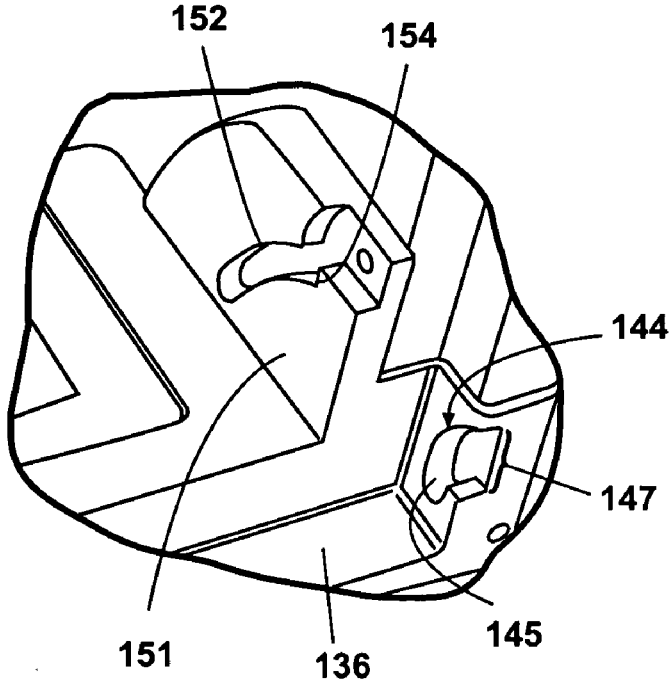
FIG. 15 is a partial perspective view of an ice bin base that can be used with the ice dispensing system embodiment of FIGS. 7-9.
Figure 16:
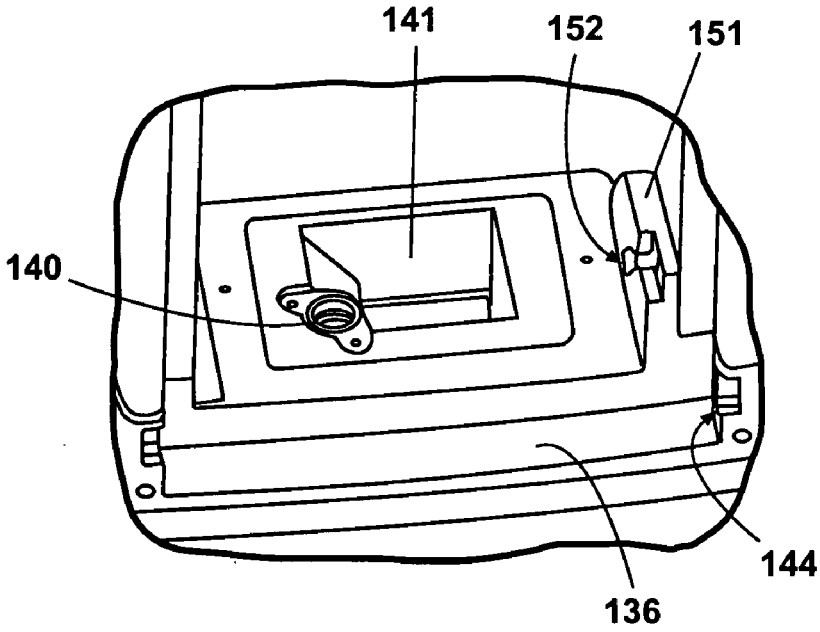
FIG. 16 is another partial perspective view of an ice bin base that can be used with the ice dispensing system embodiment of FIGS. 7-9.

Ice bin 124 can be pivotally mounted to ice bin base 136 for movement between the position in FIG. 8 to the tilted out position in FIGS. 9 and 9A. As in the embodiment of FIGS. 1-6, ice bin 124 can be removed from refrigerator compartment door 112 when ice bin 124 is in the FIG. 9 position. Turning to FIGS. 14-16, ice bin 124 can have ice bin door 125 connected to ice bin 124. Ice bin door 125 can include pivot pins 128 that can be positioned at the bottom of ice bin door edges 126. Inner door panel 116 can have an ice bin base 136 mounted to support ice bin 124 in position below ice maker 122 and ice maker cover 123. Ice bin base 136 can include a pair of sockets 144 having a recess defined by a curved wall 145 that can have a peripheral opening 147. Peripheral opening 147 can allow pivot pin 128 to be inserted into and withdrawn from socket 144 when ice bin 124 and ice bin door 125 are in the FIG. 9 position. Pivot pin 128 can be a round pin as shown in FIG. 14.

Ice bin 124 can have a stop pin 150 on side wall 130. Stop pin 150 can be positioned on side wall 130 to engage track 152 in bin stop 151 positioned on ice bin base 136 inwardly from sockets 144. Track 152 can include stop surface 154 that can be positioned to engage stop pin 150 when ice bin 124 and ice bin door 125 are in the FIG. 9 position. Those skilled in the art will under stand that stop pin 150 and stop surface 154 can function similar to stop pin 50 and stop surface 54 in the embodiment of FIGS. 1-6. In the embodiment of FIGS. 7-9 and 14-16 a stop pin 150 and stop surface 154 can be provided on one side of ice bin 124. Those skilled in the art will understand that, if desired, a stop pin 150 and stop surface 154 can be provided on both sides of ice bin 124.

Figure 10A:
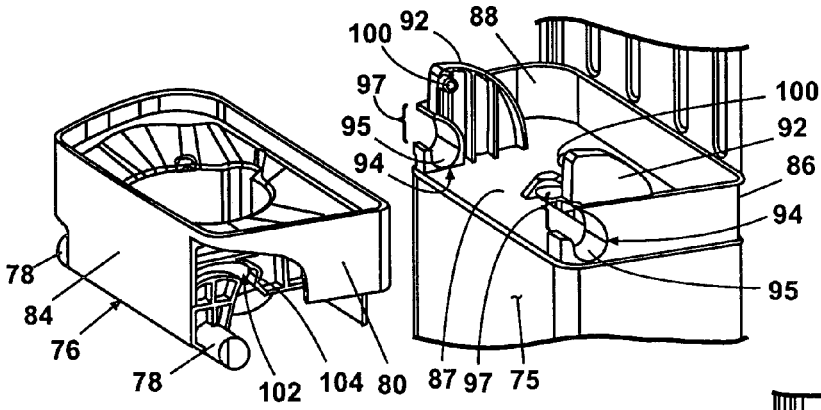
FIG. 10A is a partial perspective view of a lower ice bin member spaced from an ice bin base illustrating another embodiment of a pivot pin according to the invention.
Figure 10B:
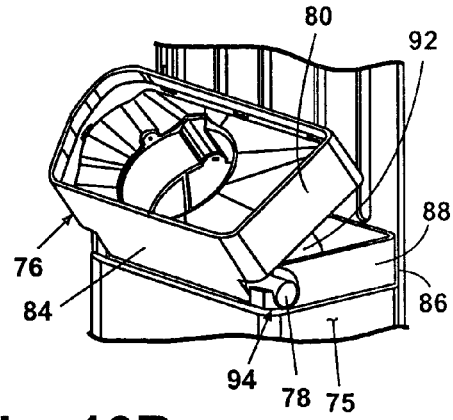
FIG. 10B is a partial perspective view of the lower ice bin member and ice bin base of FIG. 10A with the lower ice bin member installed on the ice bin base.

Referring to FIGS. 10A and 10B another embodiment of a lower ice bin member 76 and ice bin base 86 can be seen. Lower ice bin member 76 can be generally similar to lower ice bin member 26 and can include dispensing mechanism, not shown. As in the embodiment of the invention in FIGS. 1-6 the dispensing mechanism can be similar to the dispensing mechanism disclosed in U.S. Pat. Nos. 6,050,097 and 6,082,130 incorporated herein by reference. Ice bin base 86 can be generally similar to ice bin base 36 and can include a flat portion 87 and peripheral wall 88 that can provide a socket for lower ice bin member 76. Ice bin base 86 can include supports 92 that can include a socket 94. Sockets 94 can include a curved wall 95 having a peripheral opening 97 that can be arranged to receive pivot pin 78. Lower ice bin base 76 can have pivot pins 78 on the lower edge of side wall 80 adjacent front wall 84. In the embodiment of FIGS. 10 and 10A, pivot pin 76 can be generally cylindrical similar to pivot pin 128 in FIG. 14. Supports 92 can also include a stop pin 100 that can be spaced above socket 94 similar to stop pin 50 in the embodiment of FIGS. 1-6. Lower ice bin member 76 can have a track 102 formed inside side wall 80. Side wall 80 is partially cut away in FIG. 10A to expose track 102. Track 102 can be similar to track 50 in the embodiment of FIGS. 1-6. As in the case of the embodiment of FIGS. 1-6, supports 92 on both sides of lower ice bin member 76 can have a stop pin 100. Track 102 can have a stop surface 104 arranged to engage stop pin 100 when ice bin base 76 is in a tilted out position similar to ice bin 24 in FIG. 2.

Figure 11A:
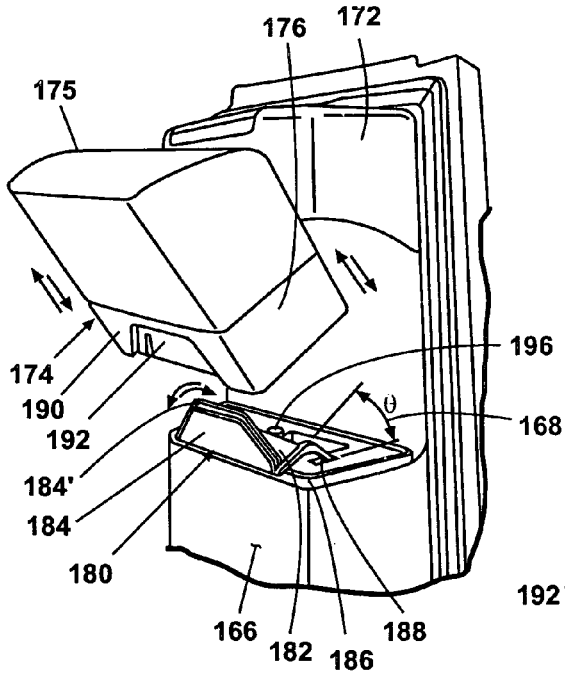
FIG. 11A is a partial perspective view of another embodiment of ice bin and ice bin base according to the invention.
Figure 11B:
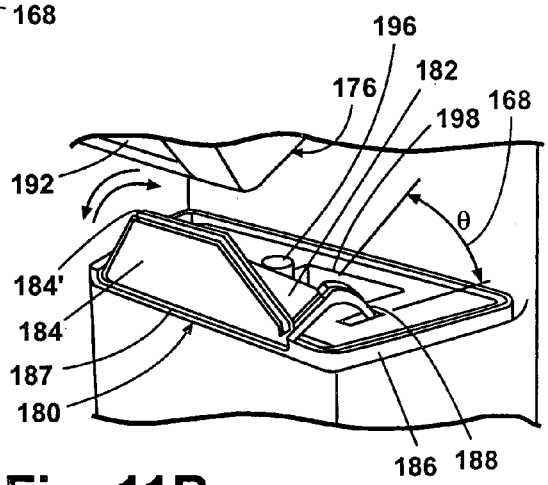
FIG. 11B is a partial perspective view of the ice bin base of the embodiment of FIG. 11A with the ice bin spaced from the ice bin base.

Turning to FIGS. 11A and 11B another embodiment of an ice bin 174 and ice bin base 186 can be seen. Ice bin 174 can be generally similar to ice bin 24 in the embodiment of FIGS. 1-6 except for the mounting arrangement to ice bin base 186. Ice bin base 186 can be mounted to inner door panel 166. Ice bin base 186 can have a plate 180 pivotally connected to ice bin base 186. Those skilled in the art will understand that plate 180 can be hinged to ice bin base 186 along an axis generally parallel to the front edge 187 of ice bin base 186. Plate 180 can have a base 182 that can be arranged to support ice bin 174. Plate 180 can also have spaced vertical elements 184 and 184' that can be positioned generally above the front edge of ice bin base 186. Lower ice bin member 176 can have a front wall 190 that can have a wall portion 192 that can be configured to be received between vertical elements 184 and 184' to hold ice bin 174 on plate 180. Plate 180 can have an arm 188 that can project downward into ice bin base 186 and can include a stop, not shown, on the distal end that can limit pivoting of plate 180 to a pivot angle 168. Those skilled in the art will understand that the stop on the distal end of arm 188 can engage the undersurface of ice bin base 186 or other surface as desired. Arm 188 can limit rotation of plate 180 to pivot angle 168 that can correspond to the pivot angle between the ice bin positions of FIG. 1 and FIG. 2.

Figure 12A:
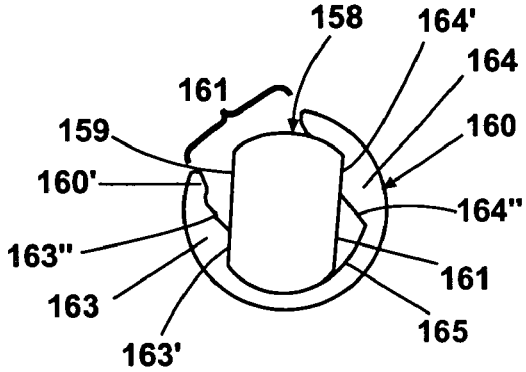
FIG. 12A is a partial schematic view of another embodiment of a pivot pin and socket according to the invention.
Figure 12B:
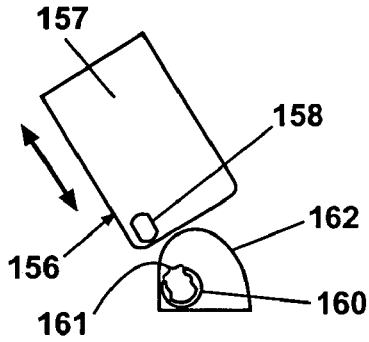
FIG. 12B is a partial schematic view of an ice bin having a pivot pin according to the embodiment of FIG. 12A positioned for insertion into a socket.
Figure 12C:
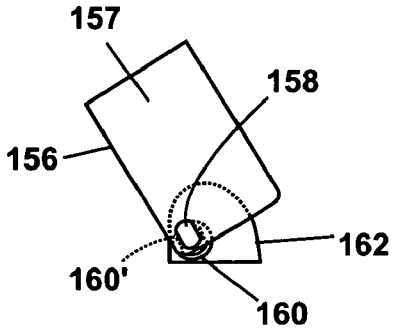
FIG. 12C is a partial schematic view illustrating the pivot pin of FIG. 12A partially inserted into the socket.
Figure 12D:
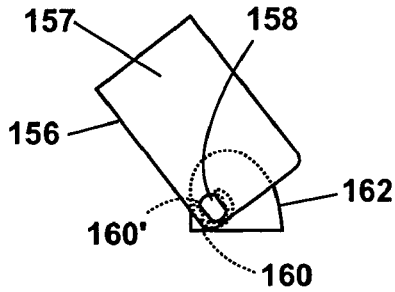
FIG. 12D is a partial schematic view illustrating the pivot pin of FIG. 12A fully inserted into the socket with the ice bin in a tilted out position as illustrated in FIG. 2.
Figure 12E:
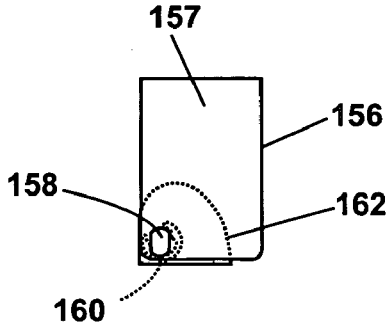
FIG. 12E is a partial schematic view illustrating the ice bin pivoted to an upright position as illustrated in FIG. 1.

Turning to FIGS. 12A-12E another embodiment of a pivot pin and socket can be seen in schematic form removed from the inner door of a refrigerator or freezer compartment. In this embodiment ice bin 156 can have a side wall 157 that can have a pivot pin 158 extending from the lower edge of side wall 157 adjacent the front wall of ice bin 156. Ice bin 156 can otherwise be similar to ice bin 24 in the embodiment of FIGS. 1-6. Pivot pin 158 can be a shaft having opposed generally flat surfaces 159 and 161, see FIG. 12A. An ice bin base, not shown, that can be generally similar to ice bin base 136 can have supports 162 that can include sockets 160. Sockets 160 can have a generally cylindrical inner wall 165 that can have a first stop 163 and a second stop 164 that can engage the generally flat surfaces 159 and 161 of pivot pin 158. Sockets 160 can also have a locking tip 160' to engage pivot pin 158 when ice bin 156 is in the tilted out position illustrated in FIG. 12D to preclude ice bin 156 from disconnecting from the ice bin base unexpectedly. First stop 163 can have a first stop surface 163' and a second stop surface 163". Similarly, second stop 164 can have a first stop surface 164' and a second stop surface 164". When ice bin 156 is in the first position, FIG. 12E, generally flat wall 159 can engage first stop surface 163' and generally flat wall 161 can engage first stop surface 164' to prevent ice bin 156 from rotating further in the clockwise direction past the FIG. 12E position. Similarly, generally flat wall 159 can engage stop 163" and generally flat wall 161 can engage stop 164" to prevent ice bin 156 from rotating further in the counterclockwise position past the FIG. 12D position. Referring to FIGS. 12B-12D installation and removal of ice bin 156 can be seen. As illustrated in FIG. 12B, ice bin 156 can be positioned above socket 160 with generally flat side walls 159 and 161 aligned with peripheral opening 161. As shown in FIGS. 12B and 12C pivot pins 158 can be inserted into socket 160 with generally flat walls 159 and 161 passing between stop surfaces 163' and 164' and locking tip 160'. When pivot pins 158 are fully inserted into sockets 160, the ice bin can be rotated to the FIG. 12D position. Ice bin 156 can be pivoted between the FIG. 12D and FIG. 12E positions as in the embodiments described above. In order to remove ice bin 156, a user can rotate the ice bin to the FIG. 12C position so that pivot pins 158 can slide past locking tip 160'.

Figure 13A:
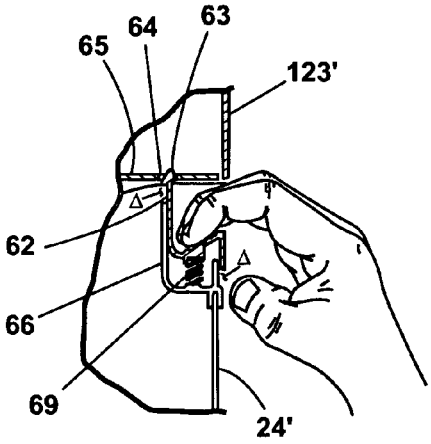
FIG. 13A is a partial schematic view illustrating one embodiment of a latch to retain an ice bin according to the invention in an upright position as illustrated in FIG. 1.
Figure 13B:
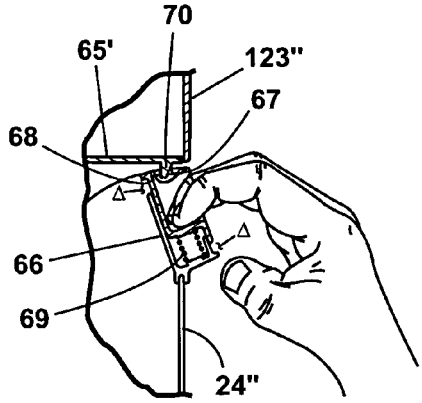
FIG. 13B is a partial schematic view illustrating another embodiment of a latch to retain an ice bin according to the invention in an upright position as illustrated in FIG. 1.

Any of the ice bin embodiments described above can be provided with a latch or a damper to secure the ice bin in position under the ice maker to assure that the ice bin does not pivot open when the door on which the ice dispenser system is mounted is opened, particular if the door is opened rapidly. Turning to FIGS. 13A and 13B two embodiments of a latch can be seen. In FIG. 13A, ice bin 24' can have a latch housing 60 provided in the upper portion of ice bin 24'. A latch 62 can be slidably mounted in latch housing 66 and can be spring biased upwardly by spring 69. Tip 63 of latch 62 can engage a strike 64 that can be formed in ice maker support 65 adjacent ice maker cover 123'. In order to release ice bin 24' to pivot outwardly to the FIG. 2 position the user can depress latch 62 to withdraw tip 63 from the strike 64 in ice maker support 65 freeing ice bin 24' to pivot outwardly. Similarly, in the embodiment of FIG. 13B, ice bin 24" can have a latch housing 66 provided in the upper portion of ice bin 24" adjacent ice maker cover 123". Latch housing 66 can have a latch 68 slidably mounted in latch housing 66 and can have a spring 69 biasing latch 68 upwardly. Ice maker support 65' can have a stop 70 that can engage strike 67 formed in the top surface of latch 68 to hold ice bin 24" in the FIG. 1 position. In order to disengage latch 68, a user can depress latch 68 allowing strike 67 to pass under stop 70 so that ice bin 24" can tilt outwardly to the FIG. 2 position. Those skilled in the art will understand that other well known latch arrangements can be used in lieu of the latch embodiments of FIGS. 13A and 13B.

Figure 13C:
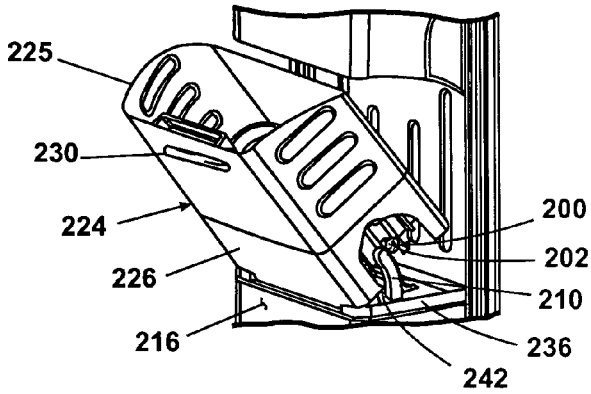
FIG. 13C is a partial schematic view illustrating one embodiment of a damper to retain an ice bin according to the invention in an upright position as illustrated in FIG. 1.

Turning to FIG. 13C another embodiment of an arrangement to assure that the ice bin does not pivot open when the door on which the ice dispenser system is mounted is opened, particular if the door is opened rapidly can be seen. Ice bin 224 can be pivotally mounted on supports 242 on ice bin base 236 in a manner similar to the embodiments described above. Ice bin 224 can include lower ice bin member 226 and upper ice bin member 225 that can be similar to the embodiments described above. Upper ice bin member 225 can include a handle 230. Lower ice bin member 226 can include a side wall 228 that is partially cut away in FIG. 13C to illustrate one damper embodiment. In FIG. 13C a damper 200 can be seen mounted on lower ice bin member 226 and can be arranged to engage curved rack 210 that can be positioned on ice bin base 236. The curvature of rack 210 can be arranged so that damper 200 can engage rack 210 as ice bin 224 moves between the position of FIG. 13C to the FIGS. 1 and 3 position. In the embodiment of FIG. 13C damper 200 can be a well known fluid damper. Damper 200 can include a gear 202 that can be connected to a disk contained in a housing, not shown, containing a viscous fluid. Rotation of gear 202 can rotate the disk in the viscous fluid so that damper 200 can slow the movement of ice bin 224 between the FIG. 1 position to the FIG. 2 position to provide a smooth steady opening and closing motion of ice bin 224. In addition, damper 200 can eliminate the need to provide a latch as illustrated in the embodiments of FIGS. 13A and 13B by requiring a user to initiate motion of ice bin 224. Those skilled in the art will appreciate that damper 200 can be other well known damper arrangements including pneumatic, hydraulic and mechanical dampers instead of a viscous damper as described above. In operation a user can grasp ice bin handle 230 to move ice bin 224 between the FIG. 1 and FIG. 2 positions. Damper 200 can allow ice bin 224 to move smoothly between the FIG. 1 and FIG. 2 positions without opening or closing hard. Those skilled in the art will understand that the ice bin illustrated in FIG. 13C can also be provided with a spring biased push-push latch so that ice bin 224 can be released from the FIG. 1 position by pressing on ice bin 224 to release the ice bin and allow the ice bin to move to the FIG. 2 position under the control of damper 200. While damper 200 is shown in FIG. 13C connected between the lower ice bin member 226 and ice bin base 236, those skilled in the art will understand that a damper can be mounted and connected as desired to smooth the motion of ice bin 224. Likewise those skilled in the art will readily understand that the other ice dispenser system embodiments described above can be provided with a damper to improve a user's experience with the ice dispensing system and also to help prevent accidental opening of a ice bin as a freezer door is moved between the open and closed positions.

While the invention has been specifically described in connection with certain specific embodiments thereof, it is to be understood that this is by way of illustration and not of limitation, and the scope of the appended claims should be construed as broadly as the prior art will permit.

What is claimed is:

1. A refrigerator comprising:

an insulated cabinet defining a refrigerated storage space;

a door pivotally mounted to the cabinet for selectively opening and closing the refrigerated storage space having an exterior face;

an ice maker in the refrigerated storage space arranged to make and harvest ice pieces;

an ice delivery system on the inside of the door for dispensing ice pieces into a dispenser cavity in the exterior face of the door including:

an ice bin including a generally open top and having a bottom opening, the ice bin being pivotally mounted below the ice maker to receive ice pieces harvested by the ice maker and to discharge ice pieces through the bottom opening and the ice delivery system in a first position, and to tilt out to permit access to ice pieces in a second position when the door is open;

a pair of pivot pins on the ice bin; and an ice bin base including a pair of sockets for receiving the pivot pins to pivotally mount the ice bin on a generally horizontal axis to the ice bin base.

2. The refrigerator according to claim 1, wherein the ice bin can be removed from the refrigerator in the second position.

3. The refrigerator according to claim 1, wherein the ice maker is mounted on the door and closes the open top of the ice bin when the ice bin is in the first position.

4. The refrigerator according to claim 1, wherein the ice delivery system includes a motor, the ice bin includes an auger, and the auger is drivingly connected to the motor when the ice bin is in the first position.

5. The refrigerator according to claim 1, wherein the sockets include a peripheral opening for insertion and withdrawal of the pivot pins into and from the sockets when the ice bin is in the second position.

6. The refrigerator according to claim 5, wherein the ice bin includes side walls, a front wall and a rear wall, and wherein the pivot pins comprise a generally D-shaped pin on each of the side walls adjacent the bottom edge of the side wall and the front wall; and wherein the sockets comprise a support extending upwardly from the ice bin base, and having a recess including a curvilinear wall defining the socket to receive the D-shaped pin.

7. The refrigerator according to claim 6, wherein the D-shaped pin comprises a curved wall and a generally flat wall, and wherein the D-shaped pin curved wall engages the socket curvilinear wall to form a moving pivot point for the ice bin as the ice bin is pivoted from the first position to the second position.

8. The refrigerator according to claim 7, wherein the socket curvilinear wall comprises the locus of the pivot points as the ice bin rotates from the first position to the second position, and wherein the pivot point for the ice bin in the second position is above the pivot point for the bin in the first position.

9. The refrigerator according to claim 5, wherein the ice bin includes side walls, a front wall and a rear wall, and wherein the pivot pins comprise a generally cylindrical pin on a side wall of the ice bin adjacent the bottom edge of the side wall and the front wall; and wherein the sockets comprise a support extending upwardly from the ice bin base having a recess including a generally cylindrical wall defining the socket to receive the generally cylindrical pin.

10. The refrigerator according to claim 5, wherein the ice bin includes side walls, a front wall and a rear wall, and wherein the sockets comprise a support extending upwardly from the ice bin base having a recess for receiving one of the pivot pins, at least one of the supports further including a stop pin positioned above the socket, and the ice bin further including a curved track on at least one side wall of the ice bin arranged for receiving the at least one stop pin and having a stop surface to engage the stop pin when the ice bin is in the second position to prevent the ice bin from pivoting past the second position.

11. The refrigerator according to claim 10, the ice bin base further including a stop arranged to engage the inside surface of front wall when the ice bin is in the second position to prevent the ice bin from pivoting past the second position.

12. The refrigerator according to claim 5, wherein the ice bin includes side walls, a front wall and a rear wall, and wherein the pivot pins comprise a shaft having opposed generally flat surfaces, and wherein the sockets have a recess including a first stop having first and second stop surfaces to engage one of the flat surfaces and a second stop having first and second stop surfaces to engage the other flat surface, wherein when the ice bin is in the first position the first stop surfaces engage opposite flat surfaces to prevent the shaft from rotating further toward the first position, and when the ice bin is in the second position the second stop surfaces engage opposite flat surfaces to prevent the shaft from rotating further toward the second position.

13. The refrigerator according to claim 12, wherein the recess in generally cylindrical and the first stop and the second stop extend inwardly from the generally cylindrical surface.

14. The refrigerator according to claim 1, wherein the refrigerator is a side by side refrigerator freezer and wherein the door is the freezer compartment door, and further wherein the ice maker is mounted on the door above the ice bin and closes the open top of the ice bin when the ice bin is in the first position.

15. A refrigerator comprising:

an insulated cabinet defining a refrigertaed storage space;

a door pivotally mounted to the cabinet for selectively opening and closing the refrigerated storage space having an exterior face;

an ice maker in the refrigertaed storage space arranged to make and harvest ice pieces;

an ice delivery system on the inside of the door for dispensing ice pieces into a dispenser cavity in the exterior face of the door including:

an ice bin including a generally open top and having a bottom opening, the ice bin being pivotally mounted below the ice maker to receive ice pieces harvested by the ice maker and to discharge ice pieces through the bottom opening and the ice delivery system in a first position, and to tilt out to permit access to ice pieces in a second position when the door is open; and an ice bin base including a plate pivotally mounted on the ice bin base, wherein the ice bin engages the plate for pivotal movement on a generally horizontal axis with the plate.

16. The refrigerator according to claim 15, wherein in the plate includes a base and at least one vertical element, and wherein ice bin further includes a wall arranged to engage the at least one vertical element to hold the ice bin on the plate.

17. The refrigerator according to claim 16, wherein the plate includes spaced vertical elements and the wall includes a portion arranged to be received between the spaced vertical elements and wherein the wall portion and the vertical elements are arranged to allow the ice bin to be removed from the plate when the ice bin is in the second position.

18. A refrigerator comprising:

an insulated cabinet defining a refrigertaed storage space;

a door pivotally mounted to the cabinet for selectively opening and closing the refrigerated storage space having an exterior face;

an ice maker in the refrigertaed storage space arranged to make and harvest ice pieces;

an ice delivery system on the inside of the door for dispensing ice pieces into a dispenser cavity in the exterior face of the door including:

an ice bin including a generally open top and having a bottom opening, the ice bin being pivotally mounted below the ice maker to receive ice pieces harvested by the ice maker and to discharge ice pieces through the bottom opening and the ice delivery system in a first position, and to tilt out to permit access to ice pieces in a second position when the door is open;

wherein the ice maker is mounted on the door and closes the open top of the ice bin when the ice bin is in the first position, and the ice bin further includes a latch arranged to secure the ice bin in the first position under the ice maker.

19. A refrigerator comprising:

an insulated cabinet defining a refrigerated storage space;

a door pivotally mounted to the cabinet for selectively opening and closing the refrigerated storage space having an exterior face;

an ice maker in the refrigerated storage space arranged to make and harvest ice pieces;

an ice delivery system on the inside of the door for dispensing ice pieces into a dispenser cavity in the exterior face of the door including:

an ice bin including a generally open top and having a bottom opening, the ice bin being pivotally mounted below the ice maker to receive ice pieces harvested by the ice maker and to discharge ice pieces through the bottom opening and the ice delivery system in a first position, and to tilt out to permit access to ice pieces in a second position when the door is open and further including a damper connected between the ice bin and the door to damp movement of the ice bin between the first position and the second position.

20. The refrigerator according to claim 19, ice delivery system further including an ice bin base and wherein ice bin is pivotally mounted to the ice bin base and the damper comprises a viscous damper connected between the ice bin and the ice bin base.

21. A refrigerator comprising:

an insulated cabinet defining a refrigerated storage space;

a door pivotally mounted to the cabinet for selectively opening and closing the refrigerated storage space having an exterior face;

an ice maker in the refrigerated storage space arranged to make and harvest ice pieces;

an ice delivery system on the inside of the door for dispensing ice pieces into a dispenser cavity in the exterior face of the door including:

an ice bin including a generally open top and having a bottom opening, the ice bin being pivotally mounted below the ice maker to receive ice pieces harvested by the ice maker and to discharge ice pieces through the bottom opening and the ice delivery system in a first position, and to tilt out to permit access to ice pieces in a second position when the door is open;

wherein the refrigerator is a bottom freezer refrigerator freezer, the door is a refrigerator compartment door, ice maker is mounted on the door above the ice bin, and below freezing air is supplied to the door for the ice maker and the ice bin, and further wherein the ice maker and ice bin include a closure arranged to enclose below freezing air supplied to the door.

22. The refrigerator according to claim 21, the ice bin further including a pair of pivot pins, and the ice dispenser system further including an ice bin base having a pair of sockets arranged to receive the pivot pins to pivotally mount the ice bin to the ice bin base on a generally horizontal axis.

23. The refrigerator according to claim 22, the ice bin further including side walls and at least one stop pin positioned on a side wall, the ice bin base further including a bin stop extending upwardly from the ice bin base spaced from the socket, the bin stop having a curved slot arranged to receive the stop pin when the ice bin is positioned on the ice bin base, wherein the curved slot includes a stop surface arranged to engage the stop pin when the ice bin is in the second position.

24. A refrigerator freezer including a freezer compartment having a access opening and a freezer door for closing the freezer compartment, the refrigerator freezer comprising:

an ice maker positioned on the freezer door;

an ice delivery system on the freezer door for dispensing ice pieces into a dispenser cavity in the exterior face of the freezer door comprising:

an ice bin positioned below the ice maker and having a generally open top, side walls, a front wall and a bottom opening;

an ice bin base mounted on the freezer door removably supporting the ice bin for pivotal movement along a generally horizontal axis between a first position with the open top closed by the ice maker to receive ice pieces harvested by the ice maker and to discharge ice pieces through the bottom opening to the dispenser cavity, and to pivot to a second position with the open top exposed to permit access to ice pieces and removal of the ice bin from the ice bin base when the freezer door is open;

a pair of pivot pins on the ice bin;

a pair of sockets on the ice bin base each having a recess comprising a curvilinear wall arranged to receive a pivot pin to pivotally mount the ice bin to the ice bin base and including a peripheral opening into the recess for insertion and withdrawal of a pivot pin into and from the recess when the ice bin is in the second position.

25. The refrigerator freezer according to claim 24, wherein the pivot pins comprise a generally D-shaped pin on each of the side walls of the ice bin adjacent the bottom edge of the side wall and the front wall, the D-shaped pin comprising a curved wall and a generally flat wall, and wherein the sockets comprise a support extending upwardly from the ice bin base ahving a recess including a curvilinear wall defining a socket to receive the D-shaped pin, and further wherein the curved wall engages the curvilinear wall to form a moving pivot point for the ice bin as the ice bin is pivoted from the first position to the second position.

26. The refrigerator freezer according to claim 25, the ice bin base further including a stop pin extending upwardly from at least one support above the socket, the ice bin further including at least one bin stop positioned on a side wall, the bin stop having a curved slot arranged to receive the stop pin when the ice bin is positioned on the ice bin base and a stop surface arranged to engage the stop pin when the ice bin is in the second position.

27. A refrigerator freezer including a refrigerator compartment having a access opening and a refrigerator door for closing the refrigerator compartment, the refrigerator freezer comprising:

a below freezing air supply to the refrigerator door;

an ice maker positioned on the refrigerator door;

an ice delivery system on the refrigerator door for dispensing ice pieces into a dispenser cavity in the exterior face of the refrigerator door comprising:

an ice bin positioned below the ice maker and having a generally open top, side walls, a front wall and a bottom opening;

an ice bin base mounted on the refrigerator door removably supporting the ice bin for pivotal movement along a generally horizontal axis between a first position with the open top closed by the ice maker to receive ice pieces harvested by the ice maker and to discharge ice pieces through the bottom opening to the dispenser cavity, and to pivot to a second position with the open top exposed to permit access to ice pieces and removal of the ice bin from the ice bin base when the freezer door is open;

a pair of pivot pins on the ice bin;

a pair of sockets on the ice bin base each having a recess arranged to receive a pivot pin to pivotally mount the ice bin to the ice bin base and including a peripheral opening into the recess for insertion and withdrawal of a pivot pin into and from the recess when the ice bin is in the second position; and a closure for the ice maker and the ice bin arranged to enclose below freezing air supplied to the refrigerator door for the ice maker and ice bin.

28. The refrigerator freezer according to claim 27, the ice bin further including side walls and at least one stop pin positioned on a side wall, the ice bin base further including a bin stop extending upwardly from the ice bin base spaced from the socket, the bin stop having a curved slot arranged to receive the stop pin when the ice bin is positioned on the ice bin base, wherein the curved slot includes a stop surface arranged to engage the stop pin when the ice bin is in the second position.

* * * * *